US007685790B2

(12) United States Patent
Stone

(10) Patent No.: US 7,685,790 B2
(45) Date of Patent: Mar. 30, 2010

(54) FLOOR MEMBER

(75) Inventor: Norman Stone, Harrison, NY (US)

(73) Assignee: Tru Woods Limited, Hong Kong (CN)

( * ) Notice: Subject to any disclaimer, the term of this patent is extended or adjusted under 35 U.S.C. 154(b) by 0 days.

(21) Appl. No.: 12/122,463

(22) Filed: May 16, 2008

(65) Prior Publication Data

US 2008/0289277 A1 Nov. 27, 2008

Related U.S. Application Data

(60) Provisional application No. 60/940,141, filed on May 25, 2007.

(51) Int. Cl.

| | |
|---|---|
| ***E04B 2/06*** | (2006.01) |
| ***E04B 2/18*** | (2006.01) |
| ***E04B 2/32*** | (2006.01) |
| ***E04B 2/46*** | (2006.01) |

(52) U.S. Cl. ..... 52/591.4; 52/506; 52/611; 52/451; 52/462; 428/40.4; 428/157

(58) Field of Classification Search ..... 52/741.3, 52/403.1, 391, 392, 451, 454, 462, 420, 416; 428/40.1, 42.3, 40.4, 60, 54, 157; 156/289, 156/247, 249, 543

See application file for complete search history.

(56) References Cited

U.S. PATENT DOCUMENTS

| | | | | |
|---|---|---|---|---|
| 4,112,161 | A | 9/1978 | Sorrells | |
| 6,030,696 | A | 2/2000 | Lee | |
| 6,128,881 | A * | 10/2000 | Bue et al. | 52/582.2 |
| 7,155,871 | B1 * | 1/2007 | Stone et al. | 52/591.4 |
| 7,322,159 | B2 * | 1/2008 | Stone et al. | 52/741.3 |
| 7,458,191 | B2 * | 12/2008 | Stone | 52/591.4 |
| 2005/0158517 | A1 | 7/2005 | Rives et al. | |

FOREIGN PATENT DOCUMENTS

| | | |
|---|---|---|
| JP | 07300808 | 11/1995 |

* cited by examiner

*Primary Examiner*—Richard E Chilcot, Jr.
*Assistant Examiner*—Chi Q Nguyen
(74) *Attorney, Agent, or Firm*—Rodman & Rodman

(57) ABSTRACT

The floor member is a laminated structure in the form a floor tile or a floor plank. A bottom portion of the floor member is formed with a plurality of moisture dispersal pathways that lead toward peripheral side edges of the bottom portion. The moisture dispersal pathways permit any moisture that develops between a floor base and the bottom portion of the floor member that is installed on the floor base to flow in the moisture dispersal pathways toward at least one of the peripheral side edges of the bottom portion, for passage beyond the one peripheral side edge of the bottom portion. Adjacent tiles of a floor tile installation have communicable moisture dispersal pathways such that moisture is not entrapped below the floor member and can migrate through the communicable pathways to an outermost peripheral side edge of the floor tile installation for dissipation of moisture into the ambient air.

14 Claims, 6 Drawing Sheets

FLOOR MEMBER

BACKGROUND OF THE INVENTION

1. Field of the Invention

This invention relates to floor members that can be installed directly onto a floor base without being bonded to the floor base, and more particularly, to floor members that permit moisture that develops between the floor base and the floor members to migrate or disperse beyond the floor members for dissipation in the ambient air.

The invention also relates to floor members that can absorb a substantial amount of footwear impact noise and object movement noise when the floor members are walked upon, and when objects are moved thereon.

As used herein, the term "floor member" is intended to refer to laminated floor planks and laminated floor tiles. However for purposes of simplifying the description of the invention such description will refer to floor tiles. But, it should be understood that the invention also encompasses floor planks. Thus the concepts and structures described in connection with the term "floor tile" are also applicable to floor planks.

The term "floor tile" is also intended to include floor tiles commonly referred to as wood tile, fiberboard tile, cork tile, carpet tile, plastic tile and rubber tile.

Known laminate floor tile is often susceptible to water damage if installed on a surface that attracts or emits moisture, such as a floor base surface in a basement, garage or other location that is at or below ground level. Such moisture is usually trapped between the tile and the floor base.

When a floor tile that is installed on a floor base is exposed to moisture at the floor base the tile can absorb the entrapped moisture, and expand, resulting in distortion and buckling of the tile. Generally, a distorted floor tile takes on a permanent set whereby the tile is irreparably deformed.

Occasionally a distorted or buckled floor tile will pop up or lift up from the floor base and dislodge one or more adjacent tiles from the floor base.

It thus becomes desirable to replace the distorted tile and resecure or replace any dislodged tiles.

If the floor tile has an interlocking assembly system such as the known "click and lock system" or the known "tongue and groove system," the tile replacement procedure can be complicated and expensive, usually involving drilling and sawing to separate and remove the tiles that are to be replaced. Oftentimes tile repair and replacement must be performed repeatedly, especially if there is a persistent moisture problem at the floor base.

Some known laminated floor tiles have a tendency to amplify shoe noise when walked upon and amplify movement noise when objects are moved on the tile.

It is thus desirable to provide a floor member that permits moisture that develops below the floor member to migrate away from the floor member. It is also desirable to provide a floor member that absorbs shoe noise and moderates movement noise from objects that are moved on the surface of the floor member.

DESCRIPTION OF THE DRAWINGS

In the accompanying drawings.

Corresponding reference numbers indicate corresponding parts throughout the several views of the drawings.

DETAILED DESCRIPTION OF THE INVENTION

Figure 1:
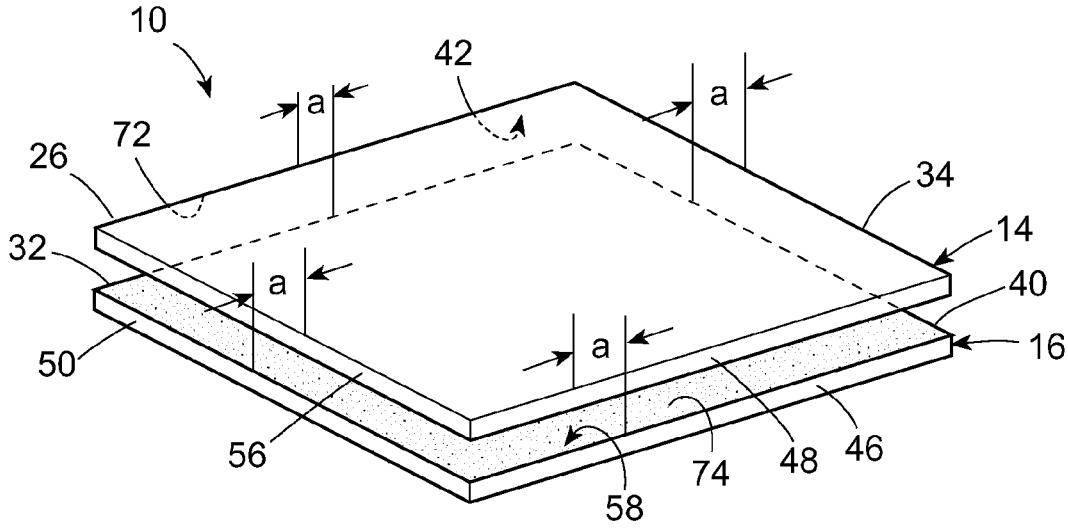
FIG. 1 is a simplified perspective view of a floor member incorporating one embodiment of the present invention.

Referring to the drawings, one embodiment of the floor member of this invention is in the form of a floor tile such as shown in FIG. 1 and generally indicated by the reference number 10.

The floor tile 10 includes a first floor member portion 14 and a second floor member portion 16 that are of identical size and shape. In a preferred embodiment of the invention the first floor member portion 14 is laminated to the second floor member portion 16 such that the first floor member portion 14 has a predetermined offset from the second floor member portion 16 in the manner described in my U.S. Pat. Nos. 7,155,871, and 7,322,159 and my U.S. application Ser. No. 11/595,559 filed Nov. 9, 2006, now U.S. Pat. No. 7,458,191, the disclosures of which are hereby incorporated by reference in this application.

In the offset arrangement of the first and second floor member portions 14 and 16 a side edge 26 (FIG. 1) of the first floor member portion 14 extends an offset amount "a" beyond a corresponding side edge 32 of the second floor member portion 16. Another side edge 34 of the first floor member portion 14, perpendicular to the side edge 26, extends the same offset amount "a" beyond a corresponding side edge 40 of the second floor member portion 16. The offsets at the side edges 26 and 34 thus define an offset L-shaped marginal section 42 (FIG. 1) of the first floor member portion 14.

Also in the offset arrangement of the first and second floor member portions 14 and 16, a side edge 46 (FIG. 1) of the second floor member portion 16 extends the offset amount "a" beyond a corresponding side edge 48 of the first floor member portion 14. Another side edge 50 of the second floor member portion 16 perpendicular to the side edge 46, extends the offset amount "a" beyond a corresponding side edge 56 of the first floor member portion 14. The offsets at the side edges 46 and 50 define an offset L-shaped marginal section 58 (FIG. 1) of the second floor member portion 16.

The L-shaped marginal section 42 of the first floor member portion 14 and the L-shaped marginal section 58 of the second floor member portion 16 are of identical size and shape.

A suitable bonding or adhesive composition for laminating the first floor member portion 14 and second floor member portion 16 together has the following components, the amounts of which are approximate:

a) 35% SIS (styrene-isoprene-styrene elastomer)

b) 54.5% petroleum resin c) 10% mineral oil d) 0.05% oxidation resistant BHT (2,6-di-tert-butyl-p-cresol)

Figure 3:
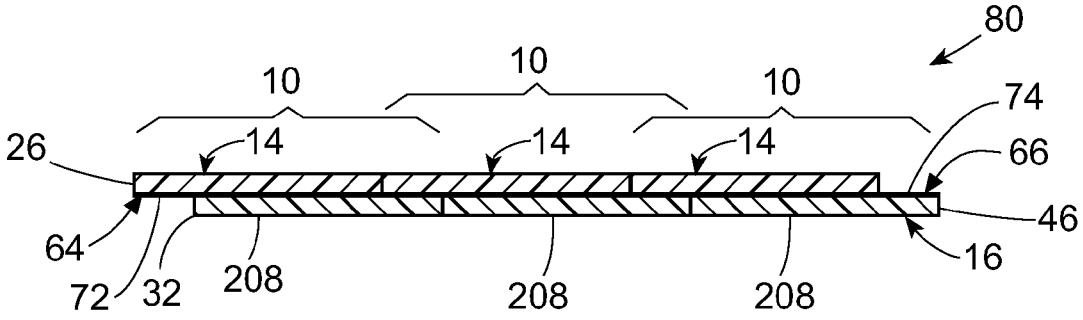
FIG. 3 is a simplified sectional view taken on the line 3-3 of FIG. 2.
Figure 4:
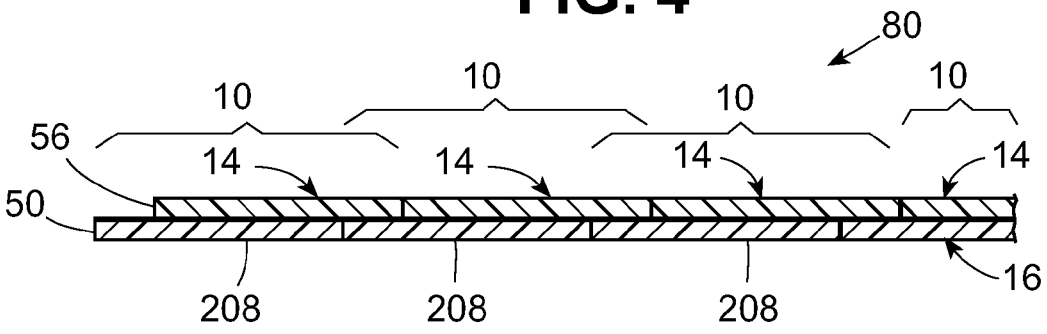
FIG. 4 is a simplified sectional view taken on the line 4-4 of FIG. 2.

The bonding material for the first and second floor member portions 14 and 16 is provided on a lower surface 64 (FIG. 3) of the first floor member portion 14 and on an upper surface 66 of the second floor member portion 16.

The L-shaped marginal section 42 has a downwardly directed adhesive surface 72 (FIGS. 1 and 3) that is part of the lower surface 64 (FIG. 3) of the first floor member portion 14 and the L-shaped marginal section 58 has an upwardly directed adhesive surface 74 (FIGS. 1 and 3) that is part of the upper surface 66 (FIG. 3) of the second floor member portion 16. The adhesive on the exposed adhesive surfaces 72 and 74 is the bonding material used for laminating the first floor member portion 14 and the second floor member portion 16 together.

Although the dimensions of the floor tile 10 are a matter of choice, a suitable size for the first floor member portion 14 and the second floor member portion 16 can be, for example, 18 inches by 18 inches. Smaller or larger size square tiles are a matter of choice. The thickness of the first floor member portion 14 can be, for example, approximately 2.0 mm and the thickness of the second floor member portion 16 can be, for example, approximately 2.5 mm. The marginal offset "a" can be, for example, approximately 1 inch. The amount of offset is a matter of choice, and larger or smaller offsets are also usable.

Figure 5:
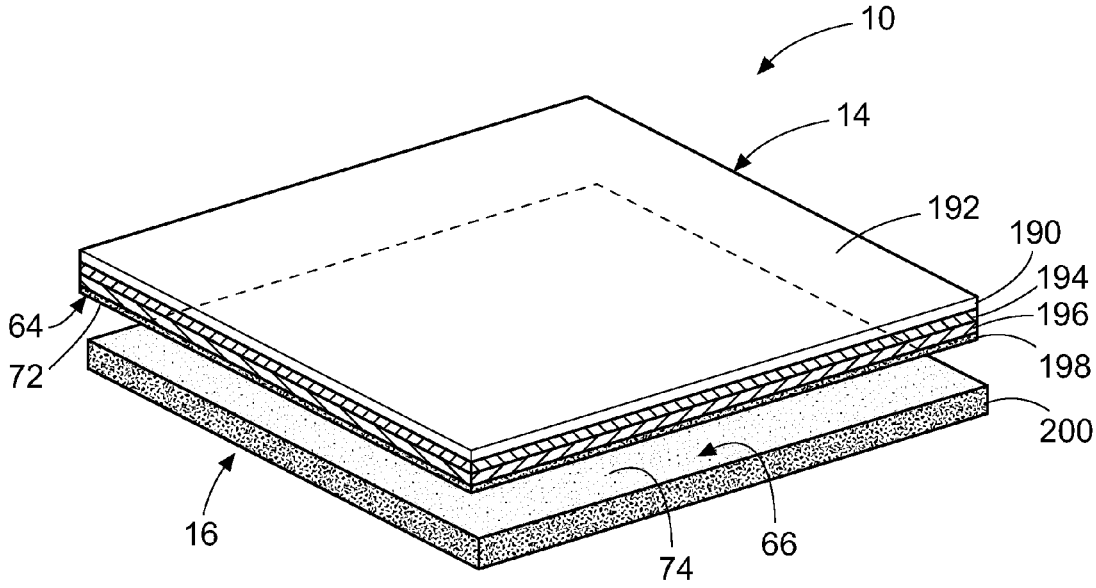
FIG. 5 is a detailed perspective view of the laminate sections of one embodiment of the floor member.

FIG. 5 shows one of the many possible known laminate configurations of the floor tile 10. If, for example, the floor 10 is a fiberboard tile, the first floor member portion 14 of the floor tile 10 can include an upper laminate section 190 formed of melamine. A top surface 192 of the upper laminate section 190 can be provided with a design (not shown), such as woodgrain, that is made in any suitable known manner.

If desired, the top surface 192 of the upper laminate section 190 can be coated or impregnated in a known manner with a suitable known clear protective thermosetting resin (not shown) to provide wear resistance and scratch resistance properties.

The upper laminate section 190 can be laminated onto a fiberboard or hardboard laminate section 194 of known fabrication in any suitable known manner.

The fiberboard laminate section 194 can be laminated in any suitable known manner onto a balance sheet or balance layer laminate section 196 of known fabrication such as Kraft paper impregnated with melamine resin. The balance layer laminate section 196 provides dimensional stability to the floor tile 10 by minimizing the effect of different coefficients of expansion of different materials that are laminated above and below the balance layer laminate section 196 and thus helps inhibit curving, cupping or arching of the floor tile 10.

The first floor member portion 14 can also include a lower transfer layer laminate section 198 (FIG. 5), formed of a known plastic material, such as semi-rigid polyvinyl chloride, laminated, in any suitable known manner, to the balance layer laminate section 196. The lower transfer layer laminate section 198 helps prevent moisture from passing through the balance layer laminate section 196 to the fiberboard laminate section 194.

The lower surface 64 (FIG. 3) of the first floor member portion 14 is also the lower surface of the transfer layer laminate section 198, and thus includes the downwardly directed adhesive surface 72.

The second floor member portion 16 includes a carrier layer 200 (FIG. 5) formed of a known plastic material, such as homogeneous polyvinyl chloride material laminated in any suitable known manner to the first floor member portion 14 in the previously described offset relationship.

The upper surface 66 (FIG. 3) of the second floor member portion 16 is also the upper surface of the carrier layer 200, and thus includes the upwardly directed adhesive surface 74.

Figure 6:
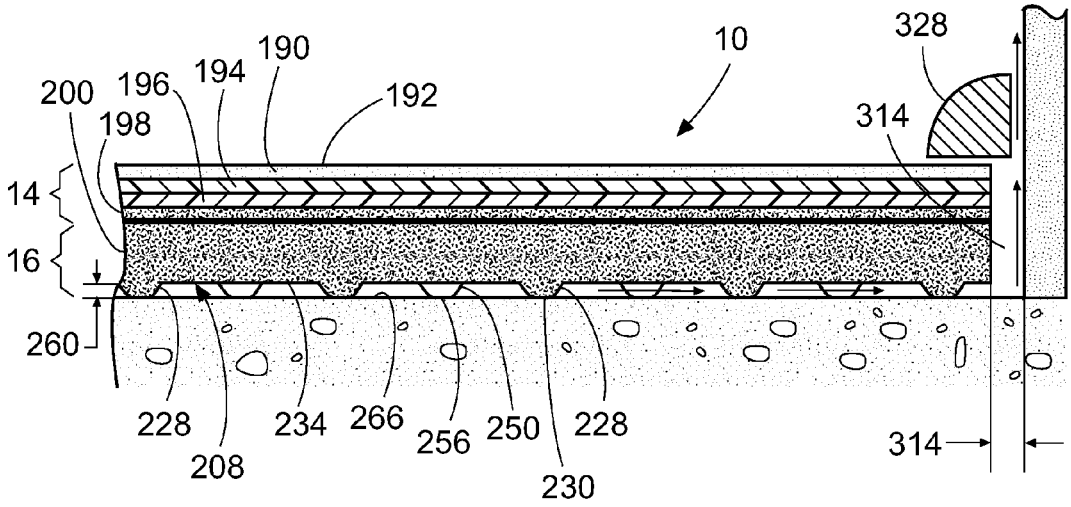
FIG. 6 is a fragmentary sectional view of the floor member taken on the line 6-6 of FIG. 9.
Figure 7:
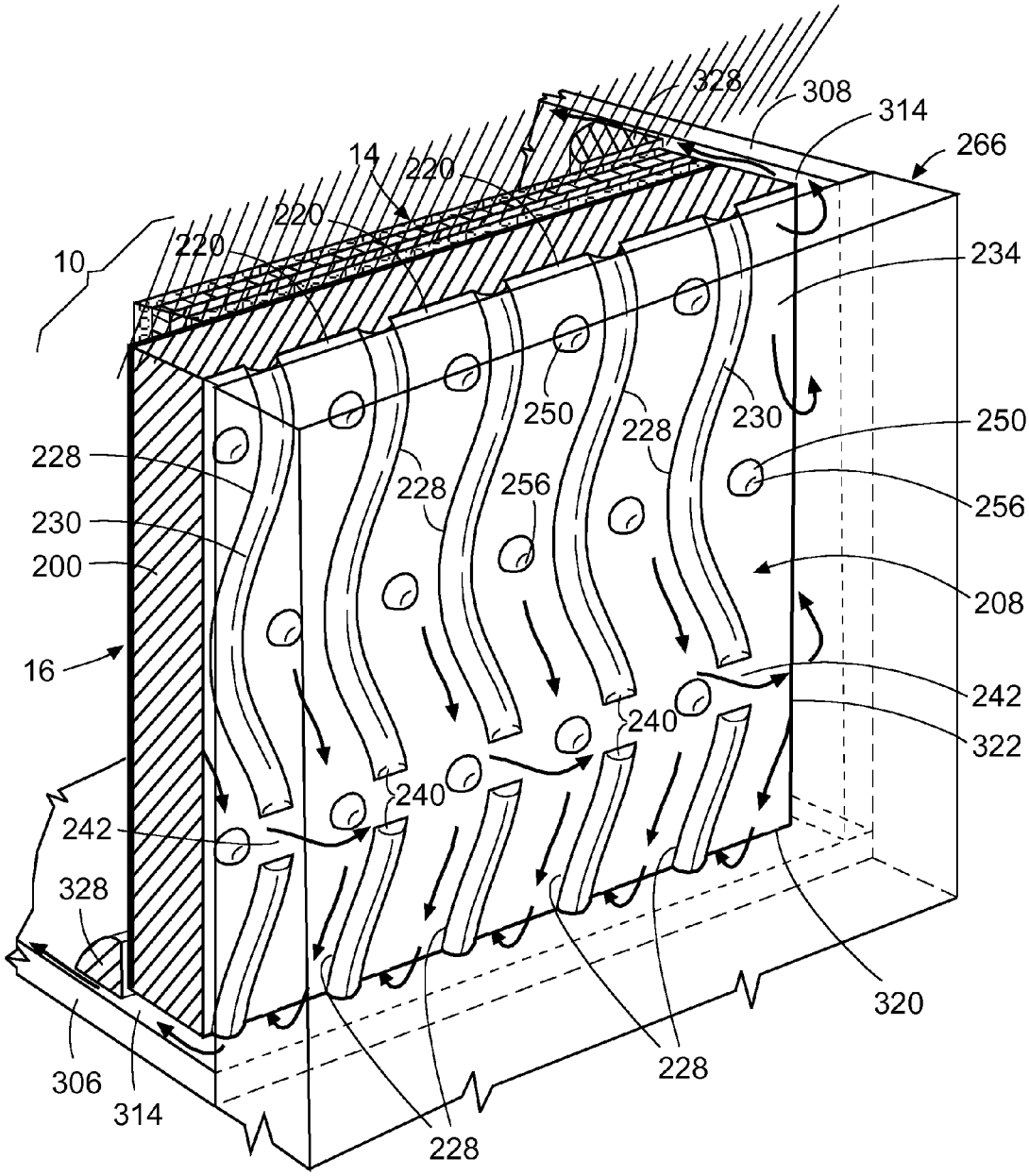
FIG. 7 is an enlarged fragmentary perspective view of the underside of the floor member of FIG. 6 with the floor base shown in simplified outline.
Figure 8:
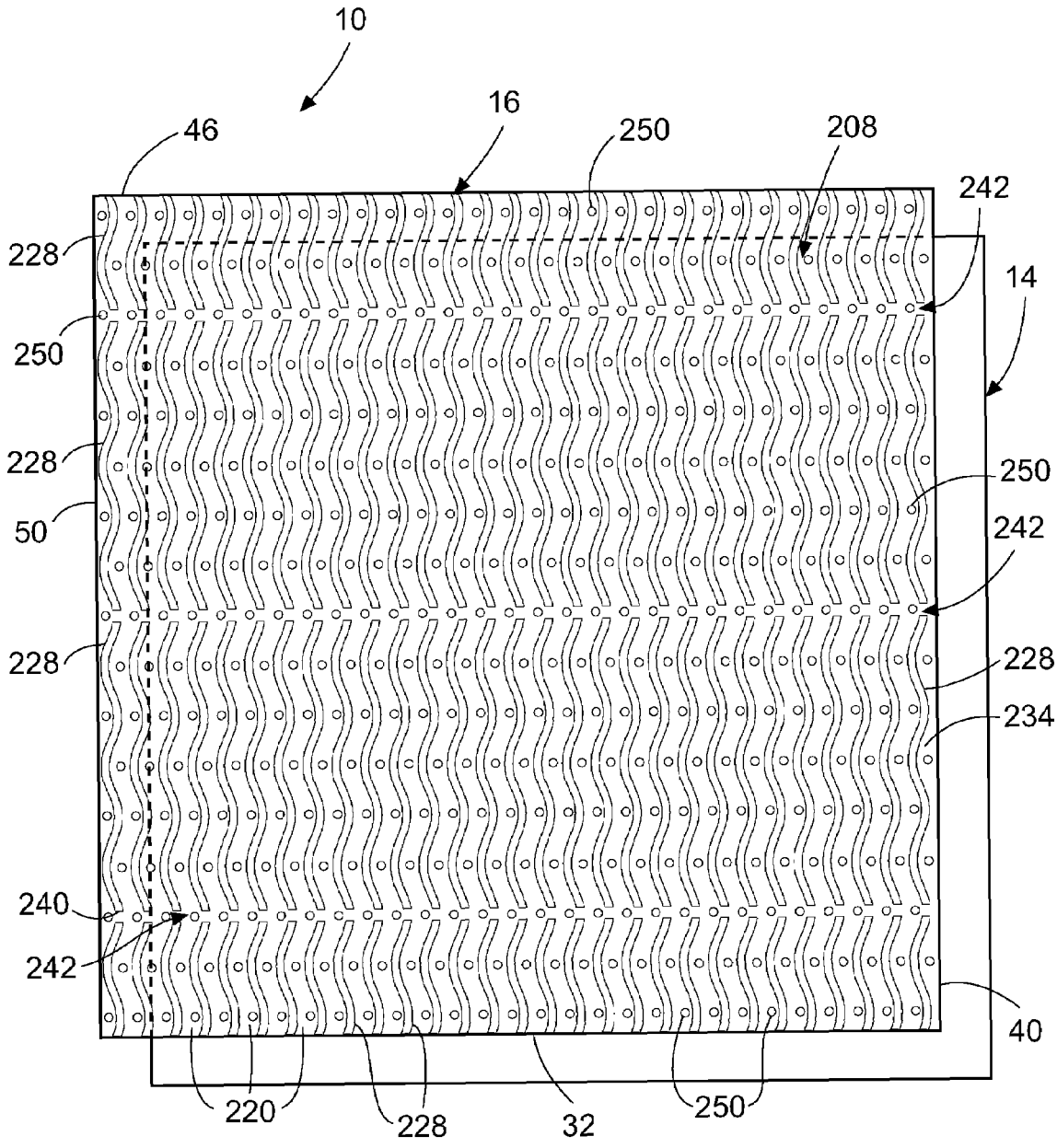
FIG. 8 is a simplified plan view of the underside of the floor member.

Referring to FIGS. 6, 7 and 8, the second floor member portion 16 includes a bottom portion 208 that is formed with a plurality of moisture dispersal or moisture migration pathways that include channels 220 and pathways 242 as most clearly shown in FIG. 7. The channels 220 are defined by spaced wall portions 228 that are formed in a repeating pattern at the bottom portion 208 such that the channels 220 are located one next to another. The wall portions 228 have a free end surface 230 (FIG. 6) that projects a predetermined amount from an undersurface 234 at the bottom portion 208.

The wall portions 228 are also provided with discontinuities such as 240 (FIG. 7). One of the discontinuities 240 of one wall portion 228 substantially aligns with corresponding discontinuities 240 of the other wall portions 228 such that the aligned discontinuities 240 define the moisture dispersal pathway 242.

Similarly other corresponding discontinuities 240 in the wall portions 228 (FIG. 8) are substantially aligned such that the corresponding aligned discontinuities 240 define other respective moisture dispersal pathways 242 of aligned discontinuities 240.

The bottom portion 208 (FIG. 7) is also formed with a plurality of column-like formations or projections 250. The columns 250 are disposed within the channels 220 and within the pathways 242 of aligned discontinuities 240, but preferably not at the point of discontinuity. The columns 250 are sized to permit the migration of moisture past the columns 250 through the channels 220 and through the pathways 242 of aligned discontinuities 240, as indicated by the moisture flow arrows in FIG. 7.

The columns 250 have a free end surface 256 (FIG. 6) that projects substantially the same amount from the undersurface 234 that the wall portion end surfaces 230 project from the undersurface 234. Preferably the end surfaces 256 of the columns 250 and the end surfaces 230 of the wall portions 228 are substantially coplanar, as most clearly shown in FIG. 6

The columns 250 can be of generally circular cross-section and can have a slightly diverging taper from the end surface 256 to the undersurface 234 (FIG. 6).

The spaced wall portions 228 and the columns 250 thus function to space the undersurface 234 a distance or amount 260 (FIG. 6) from a floor base 266 when the floor tile 10 is installed on the floor base 266. The distance 260 is approximately equal to the amount by which the wall portion end surfaces 230 and the column end surfaces 256 project from the undersurface 234 of the bottom portion 208.

Under this arrangement the undersurface 234 at the bottom portion 208 is elevated substantially the distance 260 from the floor base 266 by the wall portions 228 and the columns 250 (FIG. 6).

With the undersurface 234 thus spaced from the floor base 266 by the wall portions 228 and the columns 250, any moisture that develops between the floor base 266 and the undersurface 234 of the floor tile 10 can migrate through the channels 220 and the pathways 242 of aligned discontinuities 240 beyond at least one of the side edges 32, 40, 46 and 50 of the floor tile 10 (FIG. 8), thereby avoiding moisture entrapment between the tile 10 and the floor base 266.

Referring to FIG. 8 the channels 220 define a moisture dispersal pathway that extends from one side edge 46 of the tile 10, to the opposite side edge 32. The wall portions 228 have an undulating shape which defines an undulating path for the channels 220. The shape of the walls 228 is a matter of choice and other wall shapes such as straight walls or non-undulating curved walls (not shown) are also feasible.

Referring again to FIG. 8, the paths 242 of aligned discontinuities 240 generally extend from the side edge 40 of the tile 10 to the opposite side edge 50. Thus the channels 220 and the paths 242 of aligned discontinuities 240 constitute moisture dispersal or migration pathways that are open at the peripheral edges 32, 40, 46 and 50 of the bottom potion 208. Therefore any moisture that develops between the floor base 266 and the bottom 208 of a floor tile 10 that is installed on the floor base 266 can flow, disperse or migrate in the pathways 220 and 242 toward at least one of the peripheral edges 32, 40, 46 and 50 of the bottom portion 208, in the manner indicated in FIG. 6, thereby avoiding moisture entrapment between the floor tile 10 and the floor base 266.

In some instances the bottom portion 208 of a floor tile can be formed with channels 220 that intersect with other channels 220. For example, as shown in the tile assembly 80 of FIG. 9, a tile 10*a* has two distinct and intersecting moisture pathway patterns indicated by the reference numbers 270 and 272 that intersect at a non-projecting line of demarcation 274. Another floor tile 10*b* of the assembly 80 (FIG. 9) has, for example, three intersecting pathway patterns 278, 280 and 282, divided by non-projecting lines of demarcation 274, 274.

Although the pathway patterns 270 and 272 of the tile 10*a* intersect, and the pathway patterns 278, 280 and 282 of the tile 10*b* intersect, there is communication between moisture dispersal pathways of each pattern 270 and 272, of the tile 10*a* and communication between the moisture dispersal pathways of the patterns 278, 280 and 282 of the tile 10*b*.

For example, across the line of demarcation 274 (FIG. 9) between the intersecting pathway patterns 270 and 272, there is communication between the pathways 242 of aligned discontinuities in the pattern 270, and the channels 220 in the pattern 272.

In similar fashion, there is communication between channels 220 of the pattern 270 and channels 220 in the pattern 272 of the tile 10*a*. Similar communication occurs, across the lines of demarcation 274, 274 between the pathway patterns 278, 280 and 282 of the tile 10*b*.

Thus the floor tiles 10*a* with intersecting pathway patterns 270 and 272, and the floor tile 10*b* with intersecting pathway patterns 278, 280 and 282 permit moisture to migrate beyond at least one of their edges 32, 40, 46 and 50 at their respective bottom portions 208 (FIG. 7) to enable the tiles 10*a* and 10*b* to communicate with the moisture dispersal pathways of adjacent tiles.

Figure 2:
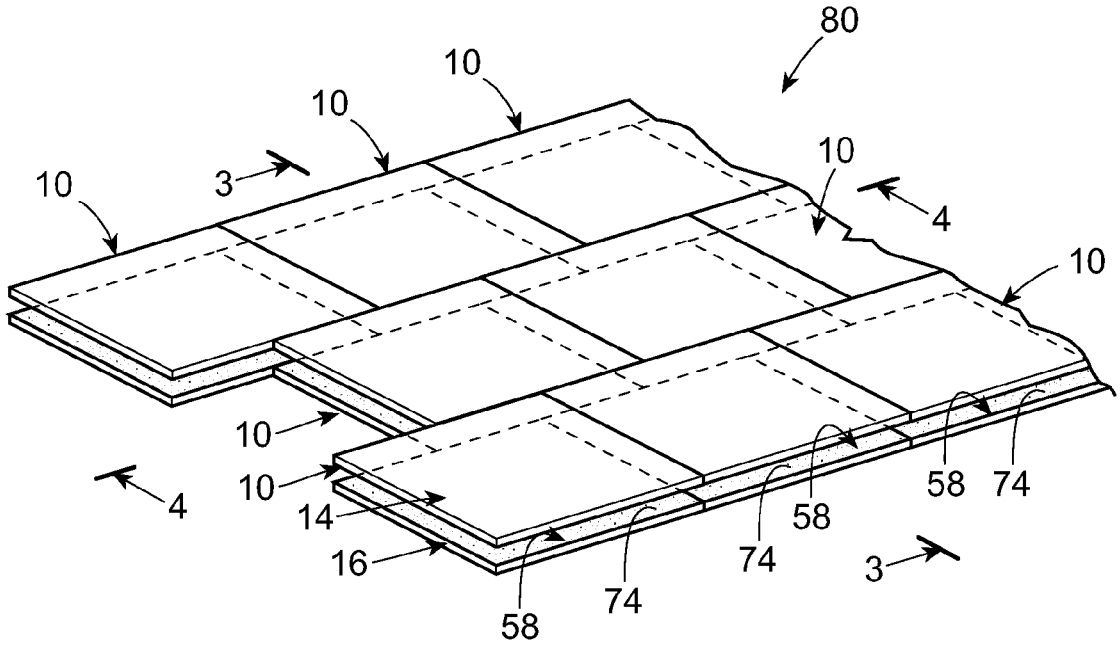
FIG. 2 is a perspective view of an assembly pattern of such floor members.

During installation of the floor tiles 10 in adjacent relationship, such as shown in the tile assembly pattern 80 of FIG. 2, the downwardly directed adhesive surface 72 (FIG. 1) of the L-shaped marginal section 42 of the top layer 14 is positioned to engage the upwardly directed adhesive surface 74 of the L-shaped marginal section 58 of the bottom layer 16 to join one tile 10 to another tile 10 and thereby form the tile assembly 80.

When placing two of the floor tiles 10 together, one of the tiles 10 can be angled at approximately 45 degrees (not shown) with respect to the floor base 266, and onto the corresponding upwardly facing adhesive surface 74 (FIG. 1) of an adjacent floor tile 10.

The floor tile assembly pattern 80 (FIG. 2) is but one example of numerous possible floor tile installation patterns known in the art.

The floor tiles 10 are preferably installed on the floor base 266 without any mastic or adhesive coating at the bottom portion 208 or at the floor base 266. Mastic-free placement of the tiles 10 on the floor base 102 keeps the moisture dispersal pathways 220 and 242 open and makes it convenient for a do-it-yourselfer to install the floor tiles 10. Thus during installation, the floor tiles 10 can be easily shifted on the floor base 266 to any selected position, thereby facilitating installation of the floor tiles 10 in any desired pattern.

Preferably the installation of floor tiles 10 should start in a corner 294 (FIG. 9) of a room 300 and proceed outwardly from the corner 294, which is defined by intersecting wall portions 306 and 308.

Figure 9:
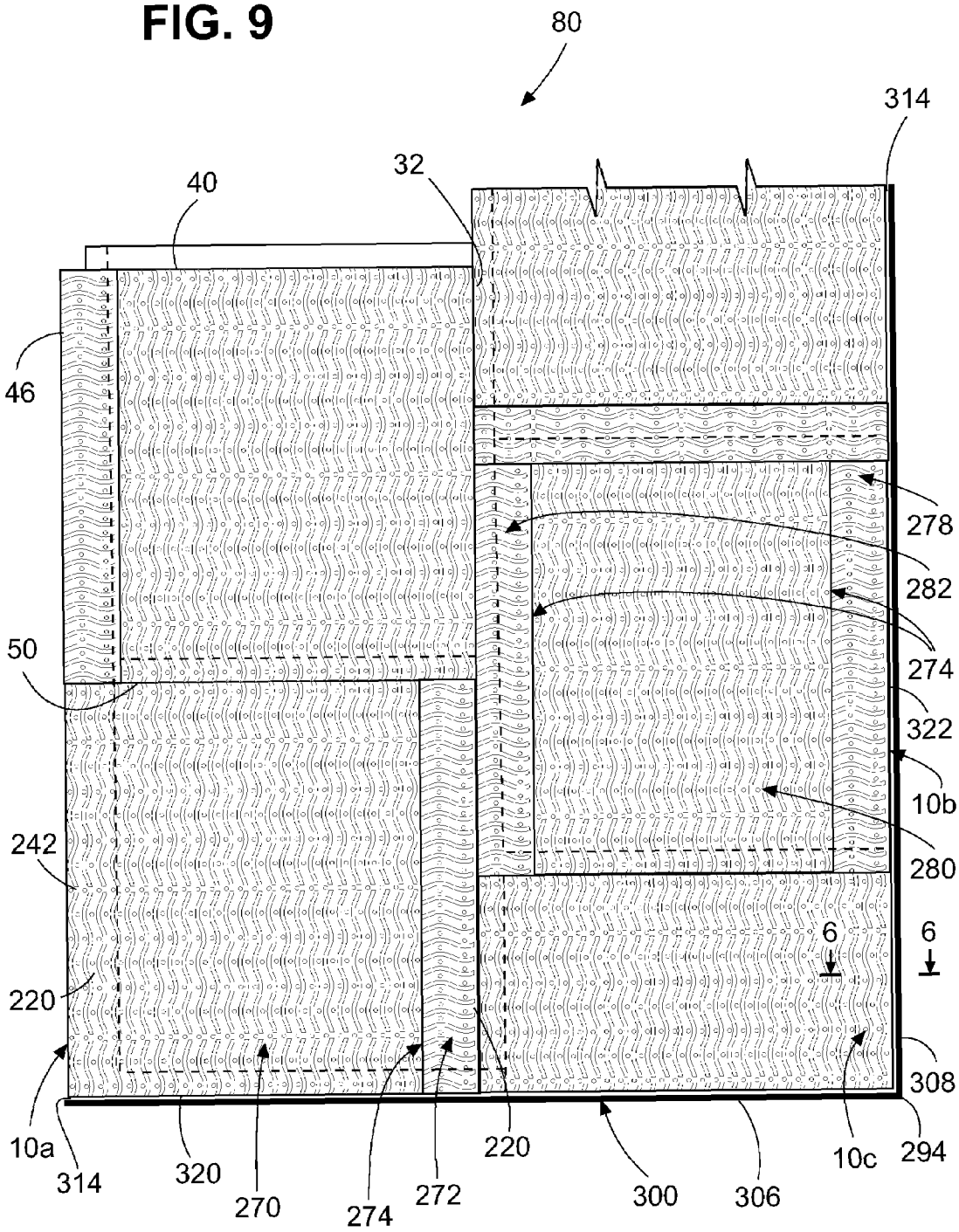
FIG. 9 is a simplified plan view of the underside of an assembly of floor members installed on a floor base, with the floor base omitted for purposes of clarity.

An expansion gap 314 (FIG. 6) of approximately ¼ inch, for example, is usually provided between the outermost edges of the floor tile assembly 80 and the adjacent walls. The expansion gap 314 is also indicated in FIG. 9 between two outermost edges 320 and 322 of the floor tile assembly 80 and the adjacent walls 306 and 308. The expansion gap 314, most clearly shown in FIG. 6, accommodates floor tile expansion that might occur after the floor tile assembly 80 is installed on the floor base 266.

In some instances the outermost edges 320 and 322 (FIG. 9) of the floor tile assembly 80 that are adjacent to the walls 306 and 308 include a trimmed tile 10*c* that is trimmed or reduced in size in any suitable known manner to install the desired pattern assembly 80 in the room 300.

The expansion gap 314 is usually covered by a molding 328 (FIG. 6). However the molding 328 does not form an airtight or moisture tight seal on the expansion gap 314. The expansion gap 314 thus allows any moisture that migrates to the expansion gap 314 to dissipate past the molding 328 into the ambient air, as shown by the moisture flow arrows in FIGS. 6 and 7.

Thus, any moisture that develops between the tile assembly 80 and the floor base 266 upon which the tile is installed, is not entrapped and can migrate through the communicable moisture dispersal or moisture migration pathways 220 and 242 of adjacent tiles. Moisture migration will progress to at least one of the outermost edges of the floor tile assembly 80 for passage into the expansion gap 314 and dissipation into the ambient air.

The moisture dispersal pathways 220 and 242 have also been found to muffle sound imposed on a surface of the tile 10. For example footwear impact noise that occurs when the floor 10 tile is walked upon and noise that occurs when objects are moved on the tile 10 are muffled or absorbed by the pathways 220 and 242 such that there is little is no amplification of noise that generally occurs with floor tiles that lack the moisture dispersal pathways disclosed herein.

The precise dimensions of the moisture dispersal pathways 220 and 242 and the column 250 may vary for different types and different sizes of floor members. However, to exemplify the magnitudes being dealt with, the wall member 228 can have a thickness of approximately 3 to 3.5 millimeters, and the amount by which the end surface 230 of the wall member 228 projects from the undersurface 234 can be approximately 0.10 to 0.20 millimeters. The spacing between wall members 228 can be approximately 4.0 to 4.5 millimeters, and the length of the wall member 228 between discontinuities, in an untrimmed tile 10, can be approximately 16 to 17 centimeters, which is the approximate distance between the discontinuities 240. The width of the discontinuities 240 can be approximately 2 to 3 millimeters. The diameter of the column 250 can be approximately 1.9 to 2.1 millimeters, and the distance between consecutive columns 250 in a channel 220 can be approximately 12 to 14 millimeters.

As various changes can be made in the above constructions and methods without departing from the scope of the invention, it is intended that all matter contained in the above description or shown in the accompanying drawings shall interpreted as illustrative and not in a limiting sense.

What is claimed is:

1. A floor member for installation on a floor base without bonding or adhering the floor member to the floor base, the floor member comprising a first floor member portion of closed periphery including a top surface for walking upon, and a second floor member portion of closed periphery offset from the first floor member portion, said second floor member portion having a bottom portion with peripheral side edges, said bottom portion being formed with a plurality of moisture dispersal pathways that include channels with spaced elongated sidewall portions arranged to lead toward at least one of the peripheral side edges of the bottom portion to permit any moisture that develops between the floor base and the bottom portion of a floor member that is installed on a floor base to flow in said channels toward said at least one peripheral side edge of the bottom portion for passage beyond the at least one peripheral side edge of the bottom portion.

2. The floor member as claimed in claim 1 wherein the spaced elongated side wall portions are formed in a repeating side by side pattern such that said channels are defined by the repeating pattern of said spaced elongated side wall portions whereby a predetermined amount of said channels are located one next to another.

3. The floor member as claimed in claim 1 wherein said spaced elongated side wall portions have an undulating shape to define an undulating path of said channels.

4. The floor member as claimed in claim 1 wherein said spaced elongated side wall portions are provided with discontinuities.

5. The floor member as claimed in claim 4 wherein predetermined discontinuities in said spaced elongated side wall portions are substantially aligned to define pathways of aligned discontinuities such that said moisture dispersal pathways further include the pathways of said aligned discontinuities, said pathways of aligned discontinuities being arranged to lead to at least a second peripheral side edge of said bottom portion to permit passage of moisture through the pathways of said aligned discontinuities beyond said at least second peripheral side edge of said bottom portion.

6. The floor member as claimed in claim 1 wherein a plurality of said floor members are installable on a floor base in adjacent relationship to form a floor covering installation to cover a desired amount of the floor base, said floor covering installation having outermost peripheral side edges, the moisture dispersal pathways of said plurality of floor members of said floor covering installation being formed such that predetermined portions of the moisture dispersal pathways of said plurality of floor members are communicable to provide moisture dispersal pathways that lead to at least one of the outermost peripheral side edges of the floor covering installation for dissipation of moisture flowing through said communicable moisture dispersal pathways to said at least one outermost peripheral side edge of the floor covering installation.

7. The floor member as claimed in claim 1 further including spaced projecting column formations provided at the bottom portion, said projecting column formations having a first free end surface, said spaced elongated side wall portions having a second free end surface and wherein the first and second free end surfaces are substantially co-planar to support the bottom portion of the floor member when the floor member is installed on a floor base, such that the moisture dispersal pathways are above the floor base.

8. The floor member as claimed in claim 1 wherein the first floor member portion includes a layer of material selected from the group consisting of wood, carpet, cork, plastic, rubber and fiberboard.

9. The floor member as claimed in claim 1 wherein the bottom portion of said second floor member portion is formed of a water resistant plastic material.

10. The floor member as claimed in claim 9 wherein the bottom portion of said second floor member portion is formed of polyvinyl chloride.

11. The floor member as claimed in claim 1 including joining means for joining said floor member to another floor member in adjacent relationship.

12. The floor member as claimed in claim 1 including joining means for joining said floor member to a plurality of said floor members in adjacent relationship and wherein said first and second floor member portions have side edges and wherein the offset of said first and second floor member portions define a first offset marginal portion of said first floor member portion and a second offset marginal portion of said second floor member portion, said first offset marginal portion of said first floor member portion extending beyond at least one of the side edges of said second floor member portion and said second offset marginal portion of said second floor member portion extending beyond at least one of the side edges of said first floor member portion, the first offset marginal portion of the floor member being joinable to a second offset marginal portion of one of said plurality of floor members in adjacent relationship and the second offset marginal portion of the floor member being joinable to the first marginal portion of another of said plurality of floor members in adjacent relationship.

13. The floor member of claim 1 in the form of a floor tile.

14. The floor member of claim 1 in the form of a floor plank.

* * * * *